US008559662B2

(12) United States Patent
Baskent

(10) Patent No.: US 8,559,662 B2
(45) Date of Patent: Oct. 15, 2013

(54) GENETIC ALGORITHMS WITH SUBJECTIVE INPUT FOR HEARING ASSISTANCE DEVICES

(75) Inventor: Deniz Baskent, Berkeley, CA (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 445 days.

(21) Appl. No.: 12/436,337

(22) Filed: May 6, 2009

(65) Prior Publication Data

US 2009/0279726 A1 Nov. 12, 2009

Related U.S. Application Data

(60) Provisional application No. 61/050,884, filed on May 6, 2008.

(51) Int. Cl.
*H04R 25/00* (2006.01)

(52) U.S. Cl.
USPC ..... 381/314; 381/23.1; 381/312; 381/313; 381/323; 381/60; 705/315; 705/14.1

(58) Field of Classification Search
USPC ..... 381/23.1, 312–314, 323, 60; 705/315, 705/14.1
See application file for complete search history.

(56) References Cited

U.S. PATENT DOCUMENTS

| | | | | |
|---|---|---|---|---|
| 6,879,860 | B2 | 4/2005 | Wakefield et al. | |
| 7,078,899 | B2 * | 7/2006 | Dale et al. | 324/314 |
| 7,149,320 | B2 | 12/2006 | Haykin et al. | |
| 7,395,235 | B2 * | 7/2008 | Dhurandhar et al. | 705/36 R |
| 7,650,004 | B2 * | 1/2010 | Durant | 381/312 |
| 7,711,662 | B2 * | 5/2010 | Buscema | 706/13 |
| 2001/0005420 | A1 * | 6/2001 | Takagi et al. | 381/312 |
| 2003/0133578 | A1 * | 7/2003 | Durant | 381/60 |
| 2003/0171122 | A1 * | 9/2003 | Kim et al. | 455/452 |
| 2004/0021516 | A1 * | 2/2004 | Oishi et al. | 330/149 |
| 2004/0030414 | A1 * | 2/2004 | Koza et al. | 700/1 |
| 2004/0102863 | A1 * | 5/2004 | Yoshida et al. | 700/97 |
| 2004/0181266 | A1 * | 9/2004 | Wakefield et al. | 607/57 |
| 2005/0107845 | A1 * | 5/2005 | Wakefield et al. | 607/57 |
| 2005/0119837 | A1 * | 6/2005 | Prakash et al. | 702/27 |

(Continued)

OTHER PUBLICATIONS

"An Analysis on Linear Crossover for Real Number Chromosomes in an Infinite Population Size" by Tatsuya Nomura, 1997 IEEE.*

(Continued)

*Primary Examiner* — Fernando L Toledo
*Assistant Examiner* — Mohammed Shamsuzzaman
(74) *Attorney, Agent, or Firm* — Schwegman Lundberg & Woessner, P.A.

(57) ABSTRACT

Disclosed herein, among other things, is an apparatus for fitting a hearing assistance device using a genetic algorithm. The apparatus includes a first population of a plurality of parent sets representing at least one device parameter. A first pair from the parent sets is presented with assistance of the hearing assistance device, the first pair comprising a first and second set. A user selects a preference between the first and second sets. A child set is determined by operating on at least one set of the plurality of parent sets. The child set can include a crossover of the at least one parent set, where the crossover includes an arithmetic or geometrical operation to parameter values of the parent set, or a mutation of the at least one parent set, where the mutation includes replacing a lowest ranked parameter value in the parent set with a randomly generated parameter value.

20 Claims, 5 Drawing Sheets

| RANK | OLD POPULATION | | NEW POPULATION |
|---|---|---|---|
| 1 | 0 10 12 20 | COPIED WITHOUT ANY CHANCE | 0 10 12 20 |
| 2 | 4 9 12 20 | MUTATED | 4 12 12 20 |
| 3 | 4 15 10 10 | CROSSOVER WITH GENE RANKED 2 | 4 13 11 15 |
| 4 | 20 2 2 4 | DISCARDED - NEW GENE PRODUCED | 2 17 4 8 |

(56) References Cited

U.S. PATENT DOCUMENTS

| | | | | |
|---|---|---|---|---|
| 2006/0161391 | A1 | 7/2006 | Inaba et al. | |
| 2006/0178711 | A1 | 8/2006 | Patrick et al. | |
| 2006/0195204 | A1* | 8/2006 | Bonabeau et al. | 700/83 |
| 2006/0271441 | A1* | 11/2006 | Mueller et al. | 705/14 |
| 2007/0076909 | A1* | 4/2007 | Roeck et al. | 381/312 |
| 2007/0135862 | A1 | 6/2007 | Nicolai et al. | |
| 2009/0048991 | A1* | 2/2009 | Kobayashi | 706/13 |
| 2010/0172524 | A1* | 7/2010 | Durant | 381/314 |
| 2010/0211512 | A1* | 8/2010 | Detwiler et al. | 705/315 |
| 2011/0016065 | A1 | 1/2011 | Chapelle et al. | |
| 2011/0046794 | A1* | 2/2011 | Duke et al. | 700/280 |
| 2011/0055120 | A1 | 3/2011 | Baskent et al. | |

OTHER PUBLICATIONS

"U.S. Appl. No. 12/550,768, Non Final Office Action mailed Mar. 29, 2012", 20 pgs.

Baskent, D, et al., "The Genetic Algorithms: A New Fitting Tool for Optimizing Hearing Aids' Advanced Features", [Online]. Retrieved from the Internet:<:http://www.starkeyresearch.com/our-research/publications.jsp, (2007), 1 pg.

Durant, Eric A, et al., "Efficient Perceptual Tuning of Hearing Aids With Genetic Algorithms", IEEE Transactions on Speech and Audio Processing, vol. 12, No. 2, (2004), 144-155.

Eiler, Cheryl, et al., "Genetic Algorithm: Are They the Future of Hearing Aid Fittings?", The Hearing Journal, 61 (12), (2008), 16-19.

Eisenberg, Laurie S, et al., "Subjective Judgments of Speech Clarity Measured by Paired Comparisons and Category Rating", Williams and Wilkins: Ear & Hearing, (1997), 294-306.

Furnkranz, Johannes, et al., "Pairwise Preference Learning and Ranking", Austrian Research Institute for Artificial Intelligence, (2003), 145-156.

Hullermeier, Eyke, et al., "Comparison of Ranking Procedures in Pairwise Preference Learning", Proceedings of the 10th International Conference on Information Processing and Management of Uncertainty in Knowledge-Based Systems, (2004), 8 pgs.

Baskent, Deniz, "Simulating listener errors in using genetic algorithms for perceptual optimization", J. Acoust. Soc. Am 121 (6), (Jun. 2007), 6 pgs.

Baskent, Deniz, et al., "Using Genetic Algorithms with Subjective Input from Human Subjects: Implications for Fitting Hearing Aids and Cochlear Implants", Ear & Hearing 28 (3). Starkey Earing Research Center, Berkeley, California, (2007), 370-380.

U.S. Appl. No. 12/550,768, Response filed Aug. 29, 2012 to Non Final Office Action mailed Mar. 29, 2012, 11 pgs.

U.S. Appl. No. 12/550,768, Notice of Allowance mailed Sep. 17, 2012, 14 pgs.

* cited by examiner

| RANK | OLD POPULATION | | | NEW POPULATION |
|---|---|---|---|---|
| 1 | 0 10 12 20 | → COPIED WITHOUT ANY CHANGE → | | 0 10 12 20 |
| 2 | 4 9 12 20 | → MUTATED → | | 4 12 12 20 |
| 3 | 4 15 10 10 | → CROSSOVER WITH GENE RANKED 2 → | | 4 13 11 15 |
| 4 | 20 2 2 4 | → DISCARDED - NEW GENE PRODUCED → | | 2 17 4 8 |

Fig. 4

GENETIC ALGORITHMS WITH SUBJECTIVE INPUT FOR HEARING ASSISTANCE DEVICES

CROSS REFERENCE TO RELATED APPLICATIONS

This application claims the benefit of U.S. Provisional Application No. 61/050,884, filed on May 6, 2008, under 35 U.S.C. §119(e), which is hereby incorporated by reference.

TECHNICAL FIELD

This application relates generally to hearing assistance devices, and more particularly to methods and apparatus for using genetic algorithms utilizing subjective user input selection from paired comparisons to efficaciously fit hearing assistance devices.

BACKGROUND

Many fields encounter problems associated with perceptually tuning a system. For example, in perceptually tuning or "fitting" a hearing assistance device, such as a hearing aid, antiquated methods subjected a single hearing impaired user to many and various audio-related settings of their hearing aid and, often via technical support from an audiologist, individually determined the preferred settings for that single user. This approach, however, has proven itself lacking in universal applicability.

Thus, prescriptive fitting formulas have evolved whereby large numbers of users can become satisfactorily fit by adjusting the same hearing assistance device. With the advent of programmable hearing aids, this approach has become especially more viable. This approach is, however, still too general because individual preferences are often ignored. In one particular hearing assistance device fitting selection strategy, paired comparisons were used. In this strategy, users were presented with a choice between two actual hearing aids from a large set of hearing aids and asked to compare them in an iterative round robin, double elimination tournament or modified simplex procedure until one hearing aid "winner" having optimum frequency-gain characteristics was converged upon. These uses of paired comparisons, however, are extremely impractical in time and financial resources. Moreover, such strategy cannot easily find implementation in an unsupervised home setting by an actual hearing aid user.

In a more recent and very limited selection strategy, genetic algorithms were blended with user input to achieve a hearing aid fitting. As is known, and as its name implies, genetic algorithms are a class of algorithms modeled upon living organisms' ability to ensure their evolutionary success via natural selection. In natural selection, the fittest organisms survive while the weakest are killed off. The next generation of organisms (children) are, thus, offspring of the fittest previous generation (parents). The algorithms also provide for mutations as insurance against the development of a relatively unchanging population incapable of continued evolution.

In breeding children or offspring in a genetic algorithm, "crossover" operators are applied to parent genes. In essence, two parent bit strings (ones and zeroes, for example) from the algorithm are crossed at a crossover point and the children are given attributes of each parent. "Mutation" operators are also applied to a relatively smaller number of parent bit strings, typically by replacing ones with zeroes and vice versa. Both crossover and mutation closely model biological behavior where parent chromosomes line up and crossover thereby swapping portions of their genetic code or become mutated.

What is needed in the art is a better and simpler selection strategy for fitting or tuning hearing assistance devices to individual users' preferred settings. The art needs better genetic algorithm operations for perceptually tuning a system having many interacting parameters, and including subjective user input.

SUMMARY

The present subject matter provides apparatus and methods for fitting a hearing assistance device using a genetic algorithm. The apparatus includes a first population of a plurality of parent sets representing at least one device parameter, in various embodiments. A first pair from the parent sets is presented with assistance of the hearing assistance device, the first pair comprising a first and second set. A user selects a preference between the first and second sets of the first pair. In an embodiment, a child set is determined by operating on at least one set of the plurality of parent sets, the child set including a crossover of the at least one parent set, where the crossover includes an arithmetic or geometrical operation to parameter values of the parent set. A child set includes a mutation of the at least one parent set, where the mutation includes replacing a lowest ranked parameter value in the parent set with a randomly generated parameter value, in an embodiment.

This summary is an overview of some of the teachings of the present application and is not intended to be an exclusive or exhaustive treatment of the present subject matter. Further details about the present subject matter are found in the detailed description. The scope of the present invention is defined by the appended claims and their equivalents.

BRIEF DESCRIPTION OF DRAWINGS

FIG. 4 illustrates a table showing examples of genetic algorithm operations, according to one embodiment of the present subject matter.

DETAILED DESCRIPTION

Figure 1A:
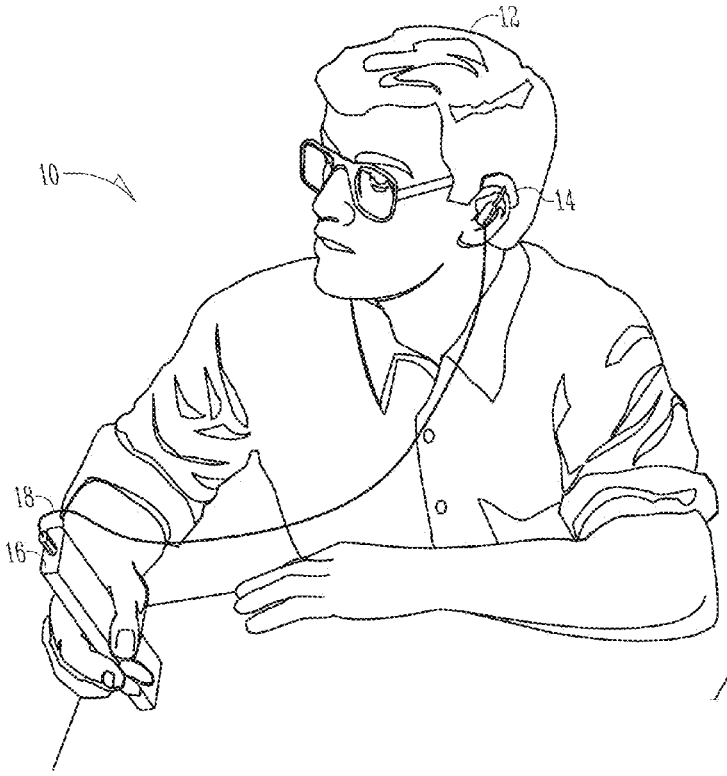
FIG. 1A illustrates a perceptual tuning system showing a hearing assistance device user and apparatus useful in an audio fitting thereof, according to one embodiment of the present subject matter.

The following detailed description refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is, therefore, not to be taken in a limiting sense, and the scope is defined only by the appended claims, along with the full scope of legal equivalents to which such claims are entitled.

The present subject matter pertains to methods and apparatus for using genetic algorithms utilizing subjective user input selection from paired comparisons to efficaciously fit hearing assistance devices. An embodiment of the apparatus includes a first population of a plurality of parent sets representing at least one device parameter. A first pair from the parent sets is presented with assistance of the hearing assistance device, the first pair comprising a first and second set. A user selects a preference between the first and second sets of the first pair. In various embodiments, a child set is determined by operating on at least one set of the plurality of parent sets, the child set including a crossover of the at least one parent set, where the crossover includes an arithmetic or geometrical operation to parameter values of the parent set. A child set includes a mutation of the at least one parent set, where the mutation includes replacing a lowest ranked parameter value in the parent set with a randomly generated parameter value, in various embodiments.

Many modern hearing assistance devices, such as hearing aids and cochlear implants for example, offer numerous features that have to be optimized for an individual user. Finding the optimal settings can be difficult, as individuals might have different pathologies in the auditory system and might also have different listening preferences. Moreover, some of the features might interact with each other, further complicating the fitting process. Theoretically, the best settings can be determined by a functional measurement that can be made for each patient and for all device features individually or in combinations. However, this would not be realistic as such a fitting would require more time and expense than most clinics or patients could afford. To simplify the fitting process for clinicians, manufacturers provide default parameter settings based on clinical and electroacoustic data, and the best parameter values for each listener are usually found by trial-and-error. This limited set of parameters might not be sufficient to provide a satisfactory fitting to all patients with varying pathologies and preferences. Furthermore, with the advances in digital signal processing and features that are becoming more sophisticated, manufacturers themselves might not be fully aware of the best default settings for new algorithms.

Optimization algorithms have been proposed for a fast, systematic, and flexible fitting of device parameters. One example of an optimization algorithm is a genetic algorithm (GA). These algorithms produce candidate parameter settings that are evaluated by a listener who listens to speech stimuli with the device under each setting. A set of device parameters is modified according to the rules of the optimization algorithm using the subjective input of the listener or patient. These steps of evaluation and modification continue in iterations until parameter settings that are satisfactory to the patient are found. Optimization algorithms are generally fast because the final solution is usually reached by evaluation of only a small fraction of all possible solutions. Flexibility is another advantage, as any device feature can be fitted with a GA. However, difficulties exist with applications involving input from human subjects. When optimization algorithms are used for fitting settings to a human listener's preferences, the main evaluation tool is the subjective response of the listener. Factors such as varying linguistic skills and speech recognition can cause difficulty of optimization. Under these conditions, there is no metric available to quantitatively measure the suitability of the final solution. The present subject matter provides for analysis of feasibility of GAs in optimizing auditory settings using the subjective input from listeners. In addition, the present subject matter provides improved methods for optimizing auditory settings of hearing assistance devices.

System for Fitting a Hearing Assistance Device

Figure 1B:
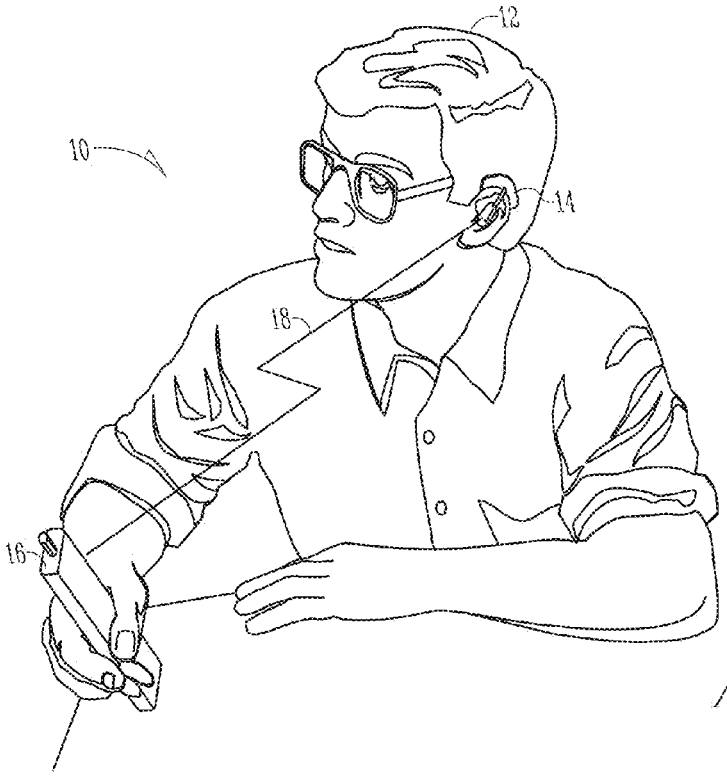
FIG. 1B illustrates a wireless perceptual tuning system showing a hearing assistance device user and apparatus useful in an audio fitting thereof, according to one embodiment of the present subject matter.

With reference to FIG. 1A, a perceptual tuning system of the present subject matter is shown generally as 10. The system, as presented in this figure and the remaining description, is in the context of fitting a hearing assistance device for a sensorineurally impaired user. It will be appreciated, however, that the system may and should be extended to various other environments, such as tuning a radio, a personal data assistant or any of a number of devices requiring such tuning. Thus, the present subject matter is not expressly limited to a hearing assistance device fitting unless so defined in the claims. As illustrated, the system 10 has a user 12 outfitted with a hearing assistance device 14, an apparatus 16 in a hand held configuration for audio fitting the hearing assistance device via user selection of paired comparisons stored in and derivable therefrom and a communications link 18 in between. In one embodiment, as depicted by FIG. 1B the communications link 18 is a wireless link and the necessary communications hardware are found in apparatus 16 and hearing assistance device 14 to support the wireless link. Apparatus 16 is a self-contained device ready for field use (e.g., home use) in an unsupervised setting. Apparatus 16 includes a personal computer, such as a desktop or laptop, in an embodiment.

It will be further appreciated that the system of FIG. 1A (or FIG. 1B) is shown as a left hearing aid configuration and one skilled in the art will be readily able to adapt the teachings herein and apply them without undue experimentation to right hearing aid embodiments and to systems having both left and right hearing aid embodiments. It will be even further appreciated that hearing assistance devices, although always having analog components, such as microphones and receivers, are generally referred to according to their primary mode of signal processing (analog processing or digital signal processing (DSP)) and can be of any type as described herein. The claims, therefore, are not to be construed as requiring a specific type of hearing assistance device. Still further, although not shown, the present subject matter may find applicability in contexts in which an audiologist uses apparatus 16 to assist user 12 in fitting hearing assistance device 14.

Figure 2:
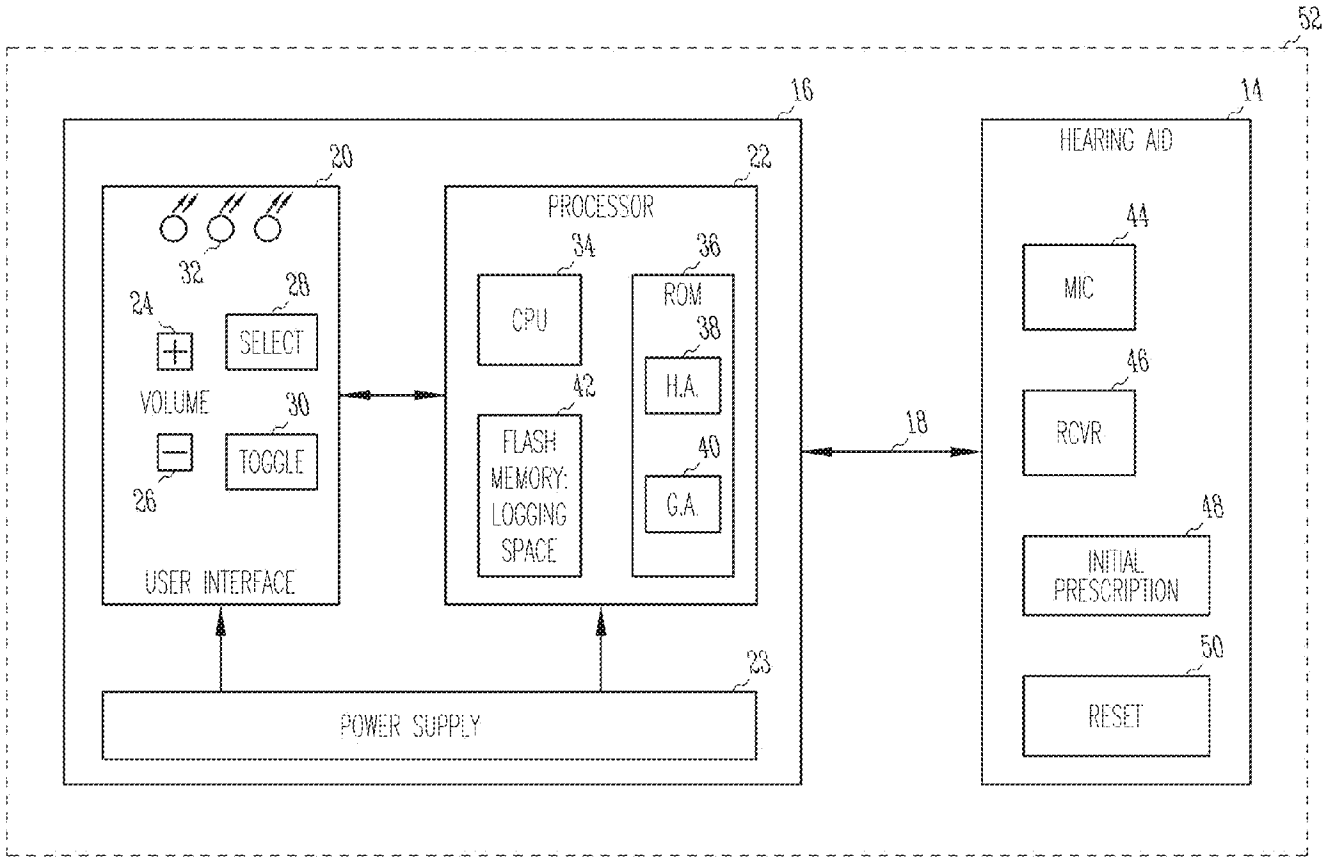
FIG. 2 illustrates a block diagram in accordance with the teachings of the present subject matter for the system of FIG. 1A or FIG. 1B, according to various embodiments of the present subject matter.

With reference to FIG. 2, the apparatus 16 and hearing assistance device 14 (shown as a hearing aid in this embodiment) of system 10 are representatively shown in block diagram format and will be described first in terms of their electromechanical interconnections. Thereafter, and with simultaneous reference to other figures, the apparatus and hearing aid of system 10 will be described in functional detail.

In the embodiment shown, apparatus 16 includes fully integrated user interface 20, processor 22 and power supply 23 for providing necessary voltage and currents to the user interface and processor. In an alternative embodiment, the apparatus 16 is separated into discrete components and/or discrete/integrated hybrids connected by appropriate communications links between the functional blocks with common or discrete internal or external power supplies. User interface 20 may include volume switches 24, 26, respectively, for increasing (+) or decreasing (−) a volume of the apparatus 16 as appropriate. Select indicator 28 is used to indicate user preference between paired comparisons. Toggle device 30 allows the user to toggle back and forth between paired comparisons as often times as necessary before indicating their preference. Other types of buttons, knobs, levers, keyboard, mouse, etc. can be used by a listener to indicate their preference, without departing from the scope of this disclosure. The volume switches 24, 26, the select indicator 28 and toggle device 30 may be any of a variety of well known integrated or discrete switches, slides, buttons, or a graphic depiction of such on a computer display, etc. They can include electromechanical switches that send electrical signals in response to a mechanical manipulation thereof. They can have appropriate size and shape to enable users to comfortably and intuitively manipulate them with very little manual dexterity. In another embodiment, the toggle device 30 is not a mechanical device to be manipulated by a user but a software algorithm stored in processor memory that automatically toggles between paired comparisons according to a preferred timing schedule. Visual indicators 32 of varying number, color and pattern are also preferably provided in the form of lights, such as light-emitting diodes (LED) to provide immediate visual feedback to the user upon manipulation of one of the user inputs. Connected to the user interface 20 is processor 22 having a central processing unit 34, preferably a DSP with internal on-chip memory, read-only memory (ROM) 36 and flash memory 42 for use as a logging space of the user inputs from user interface 20. ROM 36 preferably includes at least two algorithms, hearing aid algorithms 38 and genetic algorithms 40. In a fashion similar to that of the apparatus itself, it should be appreciated that processor 22 may be a fully integrated device or comprised of discrete components or a discrete/integrated hybrid and that all such embodiments are embraced herein. The foregoing apparatus 16 is connected at one end of the communications link 18. At the other end is the hearing aid 14. In one embodiment, the communications link 18 is a set of wire(s). In an alternate embodiment, the link 18 is wireless. The link 18 in such embodiments includes, but is not limited to, any well known or hereinafter developed communications scheme, modulated or un-modulated technologies, including, but not limited to, wireless radio frequencies, infrared transmitter/receiver pairs, Bluetooth technologies, etc. In such embodiments, suitable hardware/software processing devices would be contained in the apparatus 16 and the hearing aid 14.

As shown, the hearing assistance device (such as hearing aid 14) contains an initial prescription setting 48, a microphone 44, a receiver 46 and a reset mechanism 50. It will be appreciated the hearing assistance device also contains other mechanisms that are not shown but are well known to those skilled in the art, such as a power supply and a signal processor. In one embodiment the apparatus 16 and hearing aid 14 are discrete components. In another embodiment, the entire contents of apparatus 16 and hearing aid 14 are fully integrated into one single hearing aid package 52.

Before describing the functional operation of the apparatus 16 together with hearing aid 14, or, alternatively, completely integrated hearing aid package 52, some words and nomenclature as used throughout this specification are presented. A "parameter" as used herein relates to a characteristic element of the system 10 that can take on a discrete value. In some embodiments, the discrete value is selected from one of a range of values. In one embodiment, for example, a parameter of Filter Length, L, (in # of filter taps) the discrete parametric value is 9. It is understood that the parameter L is not limited to a particular value of 9 and can be another number. The parameter L is capable of being any of the discrete values, including, but not limited to, 1, 2, 3, 4, 5, 6, 7, 8, 9, 10, 13, 16, 20, 25, 32, 40, etc. In one embodiment, the filter length L may be as short as 1 (mere scaling of the input) and as long 256. The parameter L may be a discrete value taken from a range of countable numbers, for example, {3, 4, 5, 6, . . . , N or Infinity}. The parameter L may also be a discrete value taken from an irregular set, such as {8, 10, 13, . . . , 32, 40}, for example. Other range types and ranges are possible, and the examples given here are not intended in a limited or exclusive sense. Typically what constrains the upper limit is the size of available memory, processing speed and the ability of a user to discern differences in that many filter taps. Some particular examples of parameters for perceptually tuning a hearing assistance device may be, but are not limited to, any of the following terms well known to research audiologists and audio processing engineers skilled in the art: gain, compression ratio, expansion ratio, frequency values, such as sampling and crossover frequencies, time constant, filter length, compression threshold, noise reduction, feedback cancellation, output limiting threshold, compression channel crossover frequencies, directional filter coefficients, constrained representations of large parameter groupings, and other known or hereinafter considered parameters. A "set" as used herein is one or more parameters. A "population" is a plurality of sets. Capital letters A, B, C, D, . . . X, . . . etc., having subscripts or superscripts or both therewith will either be a particular parameter, such as $A_1$ or $A=_1$, or a particular set, such as set A, set A=, set B, set C, . . . set X, . . . etc. and will be understood from the context in which they are used. Numerous sets and sets of sets will be hereinafter presented. For clarity, they will often be presented in combination with reference to any of a variety of terms such as "parent," "child," "mutation," or "summation." These particular types of sets will also be understood from the following discussion.

Crossover

As previously stated, genetic algorithms (GAs) are optimization procedures commonly used in engineering applications. GAs can also be used for finding optimal settings for a listening situation, such as fitting hearing aids or cochlear implants to individual users or finding the best device settings for different listening environments. In such applications the search space of the algorithm is the perceptual space of the listener and the only metric to the program is the subjective input from the listener.

The GA program for such perceptual optimization works as follows: a number of possible solutions/settings comprise the population of the genes, and the best potential solutions are passed on to next generation while the poor solutions die off. In the context of perceptual optimization, the best and worst genes are determined by human listener's preferences. The genes ranked as "best" have higher probability to be passed to the next generation of the genes.

Figure 3A:
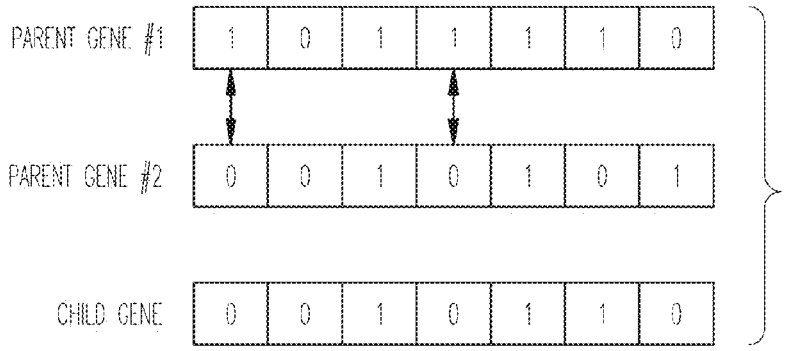
Fig.3A (Prior Art)
FIGS. 3A-3B illustrate examples of genetic algorithm crossover operations on binary parameter values.
Figure 3B:
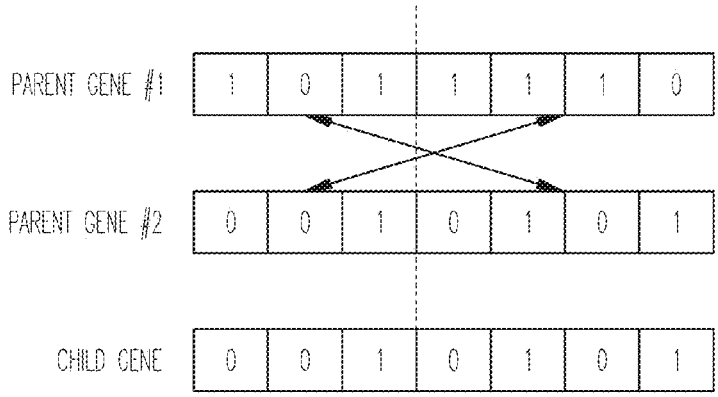
Fig.3B (Prior Art)
Figure 3C:
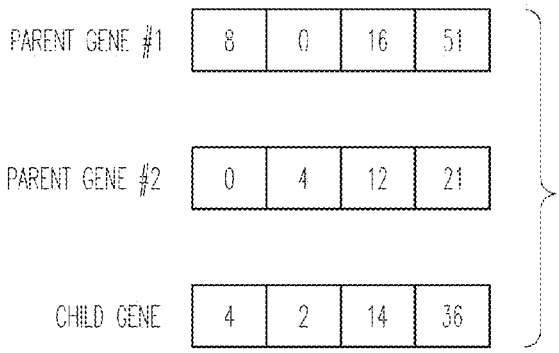
FIG. 3C illustrates an example of a genetic algorithm crossover operation using arithmetic or geometrical operators to parameter values of parent genes, according to one embodiment of the present subject matter.

There are a number of mechanisms (or GA operations) to produce the next generation of genes. One mechanism is cross-over, where the parameters of a next-generation gene are determined by an interaction between two parent genes. This process is likened to DNA formation by the mating and exchange of the DNA by two organisms. In the traditional approach, for which examples are shown in FIGS. 3A and 3B, the values of the parent genes are converted to binary values for bitstring representation, and the binary values are exchanged between the parent genes to produce binary values for the child gene. In the present subject matter, the parameter values of the child gene are produced by using arithmetic or geometrical operators to parameter values of parent genes. There is no conversion to the binary values. A simple example of these operators is averaging the parameter values of the parent genes, as shown in FIG. 3C.

In the present subject matter, the crossover mechanism used to produce child genes in the GA applications for optimizing perceptual space is realized by taking an arithmetic or geometrical operation of the parameters taken from the parent genes. This method is different than the approach where the gene values are converted to bitstring representation, and the child genes are produced by exchanging the binary values between the parent genes. In the GA application for finding optimal settings for a perceptual problem, all parameter values are meaningful. Therefore, GA operators that work on real parameters, instead of the bitstring representation, are more suitable for such usage of the GA, i.e., fitting hearing aids and cochlear implants.

Mutation

As mentioned, in the context of perceptual optimization, the best and worst genes are determined by human listener's preferences. The genes ranked as "best" have higher probability to be passed to the next generation of the genes. There are a number of mechanisms where the next generation of genes is produced. In one method, elitism, the best genes are passed to the next generation without any change. In another method, crossover, two parent genes produce child gene(s) by exchanging or averaging parameter values. In a third mechanism, mutation, parameter values are changed randomly.

In the present subject matter, another method is used, in addition to the ones listed above, to produce the genes of the new population. In this method, the worst genes of the old population are completely discarded and these genes are replaced with new genes that are produced randomly from the entire search space. This method has two advantages for perceptual optimization with interactive GAs where the fitness is determined by subjective input from the listener. First, the method ensures a number of genes independently keep searching in the entire perceptual search space. This is important as the shape of the perceptual search space is not known. In fact, the perceptual search space may have any shape; the perceptual space of a particular patient is not necessarily ordered and/or monotonically related. The search space may even change dynamically according to changing listening environments or might have multiple minima where different settings are similarly preferred by the listener. With randomly produced genes, the search is constantly conducted in the entire space while the most of the gene population is approaching to one of the minima. As a result, the probability for capturing the global minimum in an unknown and complex search space will be higher.

Second, the method increases the diversity of the gene population, which is advantageous for the specific GA application for perceptual optimization. In each iteration, the genes are ranked by the subjective judgment of the listener. To form this judgment, the listener has to listen to many gene (or parameter value) settings. If these settings are too similar to each other it will make it a much more difficult task for the listener to make a judgment; this will possibly increase the human fatigue and will also increase the possibility to make judgment errors both due to the similarity of the genes and the increased fatigue. The randomly generated gene's setting will most likely be different than the rest of the genes in the population, thereby ensuring that there is always some variation in the gene settings, which should help the listener to make judgments and reduce the fatigue.

In an alternative implementation, the GA can keep track of the previous genes that had already been judged as "bad" by the listener. When a new gene is produced from the search space randomly, the areas of the space that have been judged to be "bad" previously could be avoided.

An example for random generation is as follows: in this example, the parameters to be optimized are gain settings in dB in four channels. The genes in the old population are ranked such that the best settings are on top and the weakest are on the bottom. FIG. 4 illustrates an example of how the next generation of genes can be produced. In various embodiments, the genetic algorithm uses one or more of four mechanisms shown:

1. Elitism, where the top gene is copied onto the new population with no change.
2. Mutation, where parameters of random genes change randomly.
3. Cross-over, where parent genes produce child genes by exchanging genetic material.
4. Random generation, where the worst ranked gene is discarded and a new gene, produced randomly within the search space, replaced this gene.

The method of inserting a gene to the population by random generation can be used for perceptual optimization in varying listening environments and for auditory devices, such as hearing aids and cochlear implants. There are a number of differences compared to previous methods: 1) the present method is specifically designed for perceptual optimization using subjective input from human, 2) the present method increases the diversity of the genes to make human judgments more reliable, and 3) the present method increases diversity also to reduce human fatigue.

In the present subject matter, the worst-ranked gene(s) of the old population is (are) discarded and replaced with randomly generated gene(s) in the new population. In various embodiments, the GA may keep a record of the old genes that were not preferred strongly, and may avoid these genes in the random generation of the new genes. The random generation ensures high diversity in the gene population which could help listeners make better judgment in the paired comparisons and might also help reduce human fatigue.

Method of Fitting a Hearing Assistance Device

Figure 5:
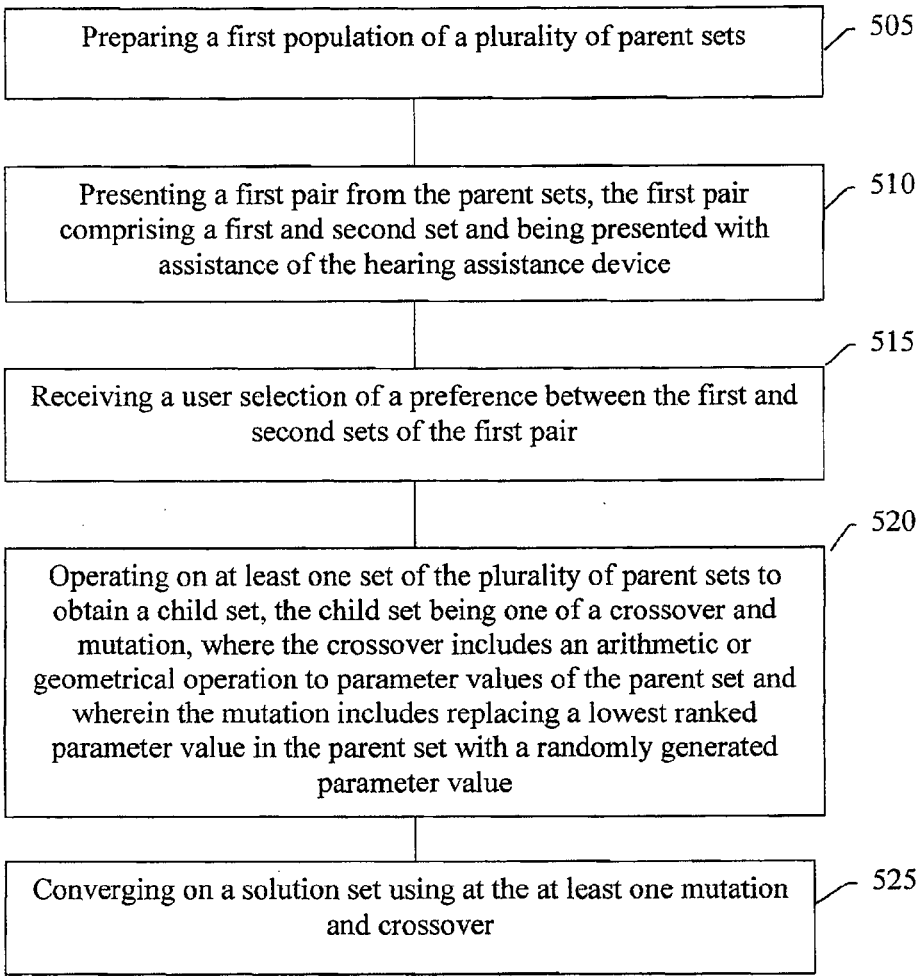
FIG. 5 illustrates a flow diagram of a method of fitting a hearing assistance device to a user, according to one embodiment of the present subject matter.

FIG. 5 illustrates a flow diagram of a method of fitting a hearing assistance device to a user, according to one embodiment of the present subject matter. According to various embodiments, the method includes preparing a first population of a plurality of parent sets, at 505. At 510, a first pair from the parent sets is presented to a user, the first pair comprising a first and second set and being presented with assistance of the hearing assistance device. A user selection of a preference between the first and second sets of the first pair is received, at 515. At 520, at least one set of the plurality of parent sets is operated on to obtain a child set. The child set is one of a crossover and mutation, where the crossover includes an arithmetic or geometrical operation to parameter values of the parent set and where the mutation includes replacing a lowest ranked parameter value in the parent set with a randomly generated parameter value, according to various embodiments. At 525, a solution set is converged upon using at the at least one mutation and crossover.

According to various embodiments of the method, converging on a solution set includes using at least one processor. The first population is randomly generated, in an embodiment. In another embodiment, the first population is generated using an initial prescription of the user. The crossover operation includes averaging parameter values, in an embodiment. According to various embodiments, the present subject matter includes a computer readable medium having executable instructions for performing the method of fitting a hearing assistance device to a user.

As previously stated, the GA is an inherently stochastic optimization method that is based on concepts related to evolution theory. Unlike conventional bitstring coding, actual parameter values are used in genes, according to various embodiments. GAs work on a population of genes (six, in an embodiment) rather than an individual set of parameters, and the genes in the initial population can be generated randomly, or by using a current prescription for a user, in various embodiments. In one embodiment, a uniform distribution is used for all random processors, except for the mutation operator. In each iteration, all genes in the population are evaluated for fitness and genes with better fitness have a higher probability to pass to the next generation. In applications that involve human subjects, the fitness is determined by the listener's preferences. In one embodiment, vocoder-processed sentences are presented in paired comparisons, 15 pairs to compare all six genes to each other, to the listener or user. The user is asked to enter a preference for the sentence with higher subjective intelligibility (A better than B, or vice versa), with an additional option for equal intelligibility (A B same). The genes that are preferred more often have higher fitness value, and all six genes of the population are then rank-ordered such that the genes with the highest and lowest fitness are ranked as the top and bottom genes, respectively. The next generation of genes is produced from the rank-ordered genes of the old population using one of these methods: (1) Elitism: the top two genes with the highest fitness values pass on to the next generation with no alterations. The top third gene is also passed on to the next generation, but with a probability of being mutated; (2) Crossover: two non-identical parent genes are randomly selected from the old population, and two new child genes are produced by averaging the parameters from the parent genes. The offspring genes replace the fourth and fifth genes of the old population; (3) Mutation: two of the three genes (third, fourth and fifth genes of the new population) are randomly selected. One randomly selected parameter of each of the two genes is changed to a randomly selected value using a normal distribution with the mean at the parameter's old value and the standard deviation of tone third of the number of levels used for the parameter to be mutated. The sixth gene in the old population is not used in producing the next generation of genes. The old one is discarded and the sixth gene of the new population is produced randomly. A purpose of the sixth gene is to increase the diversity of the genes in the new population. These steps are repeated iteratively until a convergence criterion is satisfied. In one embodiment, the convergence criterion includes: if the same two genes are ranked as the best genes of the population in three consecutive iterations, convergence is assumed; if the GA failed to converge in 15 iterations, then the program is stopped manually and the gene that is ranked as the top gene in the final iteration is accepted as the final optimal solution.

In various embodiments, no automatic stopping criterion is used. Instead, the GA is allowed to run for a specified number of iterations or a certain amount of time. According to one embodiment, the GA is run twice and the solutions to both are each programmed into memories of the device, so that the patient can have an opportunity to evaluate both settings for an extended time and for diverse listening conditions.

For most GA applications, it is beneficial to have a large number of genes, as the ability of the GA to find the optimal solution is also related to the number of genes. However, a large population size also increases time needed to find a solution, as the listener would need more time to evaluate all genes.

In perceptual optimization, the input to the program is the subjective human response and the appropriateness of the final solution is judged by the listener. In an embodiment, two human factors that can affect the outcome of the GA when used for perceptual optimization are explored with simulations. Listeners with varying sensitivity in discrimination sentence of different intelligibility and with varying error rates in entering their judgment to the GA are simulated, in the embodiment. A comparison of the simulation results with results using human subjects shows that these factors could reduce the performance of the GA considerably. GA implementation suggests that a smaller number of paired comparisons are made, with the rest being inferred from previous comparisons to shorten running time of the application. However, if the listener makes many errors, these errors might carry over to following iterations, and might cause the GA to produce poorer solutions. In various embodiments, simulations can be developed to evaluate the potential success of a specific optimization program and in deciding which operator would result in best performance, before actual testing with human listeners.

The present subject matter provides improved genetic algorithm operations for fitting hearing assistance devices using subjective input from a listener. The crossover operation disclosed herein creates child genes that are in between, or interpolated with the parents. The mutation operation disclosed herein replaces the weakest genes with randomly generated genes. This provides several benefits. Because this is a subjective evaluation, replacing with a random gene brings a new parameter setting for consideration by the listener and makes it easier to make a comparison. Also, this improves the ability to locate more optimal settings that might not be in the vicinity of the current gene population. By randomizing the selections, a more preferential setting may be determined, due to the fact that the perceptual space of a particular listener is not necessarily ordered and/or monotonically related.

It is understood that other combinations and configurations may be employed without departing from the scope of the present subject matter. This application is intended to cover adaptations or variations of the present subject matter. It is to be understood that the above description is intended to be illustrative, and not restrictive. The scope of the present subject matter should be determined with reference to the appended claims, along with the full scope of equivalents to which such claims are entitled.

What is claimed is:

1. A method of fitting a hearing assistance device to a user, comprising:

preparing a first population of a plurality of parent sets using a processor in communication with the hearing assistance device;

presenting a first pair being derived from the first population of the plurality of parent sets, the first pair comprising a first and second set and being presented to a user with assistance of the hearing assistance device;

receiving a user selection from a toggle device, the user selection including a preference between the first and second sets of the first pair;

using the processor to operate on at least one set of the plurality of parent sets to obtain a child set, the child set being one of a crossover and mutation, wherein the crossover includes an arithmetic or geometrical operation to real parameter values of the parent set instead of converting to and operating on bitstring values of the parent set and wherein the mutation includes replacing a lowest ranked parameter value in the parent set with a randomly generated parameter value and recording the lowest ranked parameter value in a memory to avoid the lowest ranked parameter value during subsequent random generation; and using the processor to converge on a solution set using at the at least one of the mutation and the crossover.

2. The method of claim 1, wherein converging on a solution set includes using a digital signal processor.

3. The method of claim 1, wherein the first population is randomly generated.

4. The method of claim 1, wherein the first population is generated using an initial prescription of the user.

5. The method of claim 1, wherein the crossover includes averaging parameter values.

6. A non-transitory computer readable medium having executable instructions for performing the steps of claim 1.

7. A method of fitting a hearing assistance device using a genetic algorithm, comprising:

using a processor to prepare a first population of a plurality of parent sets representing at least one device parameter;

presenting a first pair being derived from the first population of the plurality of parent sets, the first pair comprising a first and second set and being presented to a user with assistance of the hearing assistance device;

receiving a user selection of a preference between the first and second sets of the first pair;

using the processor to determine a child set by operating on at least one set of the plurality of parent sets, the child set including a crossover of the at least one parent set, wherein the crossover includes an arithmetic or geometrical operation to real parameter values of the parent set instead of converting to and operating on bitstring values of the parent set; and using the processor to converge on a solution set using at least one of the crossover and a mutation, wherein the mutation includes replacing a lowest ranked parameter value in the parent set with a randomly generated parameter value and recording the lowest ranked parameter value in a memory to avoid the lowest ranked parameter value during subsequent random generation.

8. The method of claim 7, wherein the child set includes a mutation of the at least one parent set, wherein the mutation includes replacing a lowest ranked parameter value in the parent set with a randomly generated parameter value.

9. The method of claim 7, wherein each parent set of the plurality of parent sets comprises more than one parameter value.

10. The method of claim 7, wherein the processor is connected to the hearing assistance device via a communication link.

11. The method of claim 10, wherein the communication link includes a wireless link.

12. The method of claim 7, wherein the processor includes a digital signal processor (DSP).

13. A non-transitory computer readable medium having executable instructions for performing the steps of claim 7.

14. A method of fitting a hearing assistance device using a genetic algorithm, comprising:

using a processor to prepare a first population of a plurality of parent sets representing at least one device parameter;

presenting a first pair being derived from the first population of the plurality of parent sets, the first pair comprising a first and second set and being presented to a user with assistance of the hearing assistance device;

receiving a user selection of a preference between the first and second sets of the first pair;

using the processor to determine a child set by operating on at least one set of the plurality of parent sets, the child set including a mutation of the at least one parent set, wherein the mutation includes replacing a lowest ranked parameter value in the parent set with a randomly generated parameter value and recording the lowest ranked parameter value in a memory to avoid the lowest ranked parameter value during subsequent random generation; and using the processor to converge on a solution set using at least one of the mutation and a crossover.

15. The method of claim 14, wherein the child set includes a crossover of the at least one parent set, wherein the crossover includes an arithmetic or geometrical operation to parameter values of the parent set.

16. The method of claim 14, wherein each parent set of the plurality of parent sets comprises more than one parameter value.

17. The method of claim 14, wherein the processor is connected to the hearing assistance device via a communication link.

18. The method of claim 17, wherein the communication link includes a wireless link.

19. The method of claim 14, wherein the processor includes a digital signal processor (DSP).

20. A non-transitory computer readable medium having executable instructions for performing the steps of claim 14.

* * * * *

UNITED STATES PATENT AND TRADEMARK OFFICE

CERTIFICATE OF CORRECTION

PATENT NO. : 8,559,662 B2
APPLICATION NO. : 12/436337
DATED : October 15, 2013
INVENTOR(S) : Deniz Baskent It is certified that error appears in the above-identified patent and that said Letters Patent is hereby corrected as shown below:

On the Title Page, Item (56)

On page 2, in column 1, under "Other Publications", line 3, delete "D," and insert --D.,--, therefor On page 2, in column 1, under "Other Publications", line 7, delete "A," and insert --A.,--, therefor On page 2, in column 2, under "Other Publications", line 3, delete "S," and insert --S.,--, therefor On page 2, in column 2, under "Other Publications", line 20, before "U.S.", insert --"--, therefor On page 2, in column 2, under "Other Publications", line 21, delete "2012," and insert --2012",--, therefor On page 2, in column 2, under "Other Publications", line 22, before "U.S.", insert --"--, therefor On page 2, in column 2, under "Other Publications", line 23, delete "2012," and insert --2012",--, therefor Signed and Sealed this
Eighteenth Day of November, 2014

Michelle K. Lee

Michelle K. Lee
*Deputy Director of the United States Patent and Trademark Office*